US008289255B2

(12) United States Patent
Chen

(10) Patent No.: US 8,289,255 B2
(45) Date of Patent: Oct. 16, 2012

(54) ELECTRO-OPTICAL APPARATUS AND DISPLAY THEREOF

(75) Inventor: He-Chen Chen, Taichung County (TW)

(73) Assignee: AU Optronics Corporation, Hsinchu (TW)

( * ) Notice: Subject to any disclaimer, the term of this patent is extended or adjusted under 35 U.S.C. 154(b) by 599 days.

(21) Appl. No.: 12/505,549

(22) Filed: Jul. 20, 2009

(65) Prior Publication Data

US 2010/0295830 A1 Nov. 25, 2010

(30) Foreign Application Priority Data

May 19, 2009 (TW) ..... 98116569 A

(51) Int. Cl.
*G09G 3/36* (2006.01)

(52) U.S. Cl. ..... 345/93; 345/204; 345/206; 345/100; 345/92

(58) Field of Classification Search ..... 345/92, 345/93, 87, 205, 100, 94, 212, 58, 98, 74, 345/208, 54, 55, 206
See application file for complete search history.

(56) References Cited

U.S. PATENT DOCUMENTS 5,748,175 A 5/1998 Shimada et al.
5,854,615 A 12/1998 Hush
5,867,139 A * 2/1999 Tanaka et al. ..... 345/92
6,075,505 A * 6/2000 Shiba et al. ..... 345/87
6,088,014 A 7/2000 Furuhashi et al.
6,111,625 A 8/2000 Ohta et al.
6,163,386 A 12/2000 Kobayashi et al.
6,295,142 B1 9/2001 Watanabe et al.
6,335,778 B1 1/2002 Kubota et al.
7,030,869 B2 4/2006 Morita
7,084,848 B2 8/2006 Senda et al.
7,187,421 B2 3/2007 Tsunashima et al.
7,193,677 B2 3/2007 Ino
7,336,273 B2 2/2008 Nakajima
7,468,720 B2 12/2008 Kim
2006/0221034 A1 * 10/2006 Nakao et al. ..... 345/92

* cited by examiner

*Primary Examiner* — Lun-Yi Lao
*Assistant Examiner* — Olga Merkoulova
(74) *Attorney, Agent, or Firm* — Jianq Chyun IP Office

(57) ABSTRACT

A display including a pixel array, scan lines, at least one dummy scan line, data lines, common lines electrically insulated from each other, common line driving units, gate driving units, and a source driving circuit. An $i^{th}$ common line is capacitively coupled to an $i^{th}$ row of the pixels. An $(i+n)^{th}$ scan line is electrically connected to an $(i+n)^{th}$ row of the pixels. The dummy scan line is disposed in at least one side of the scan lines without electrically connecting to the pixels. The common line driving units and the gate driving units are respectively disposed at two opposite sides of the pixel array. The gate driving units are respectively connected to one common line driving unit through an $i^{th}$ scan line or the dummy scan line to change a voltage of an $(i+n)^{th}$ or $(i-n)^{th}$ common line. Additionally, an electro-optical apparatus including the above-mentioned display is also provided.

16 Claims, 7 Drawing Sheets

ELECTRO-OPTICAL APPARATUS AND DISPLAY THEREOF

CROSS-REFERENCE TO RELATED APPLICATION

This application claims the priority benefit of Taiwan application serial no. 98116569, filed May 19, 2009. The entirety of the above-mentioned patent application is hereby incorporated by reference herein and made a part of specification.

BACKGROUND OF THE INVENTION

1. Field of the Invention

The present invention relates to an electro-optical apparatus and a display thereof. More particularly, the present invention relates to an electro-optical apparatus driven through a capacitive coupled driving method, and a display thereof.

2. Description of Related Art

With development of display technologies, people's life becomes more convenient with assistance of display apparatus. To meet design features of lightness and slimness, flat panel displays (FPDs) become a main stream in the market, in which a thin film transistor liquid crystal display (TFT-LCD) is a commonly used FPD. As image resolutions are increased, a charging time for each pixel in the TFT-LCD is shortened, which may lead to image quality deterioration. Accordingly, a plurality of driving method is provided to mitigate the problem of the image quality deterioration.

In various LCDs, a gate on array (GOA) technique for directly fabricating gate driving units on a glass substrate is provided. Though such kind of display can save an expensive cost of a flexible circuit board, configuration of gate driving units occupies a layout space on the glass substrate.

Moreover, regarding a display that applies a capacitive coupled (CC) driving method to display images, the display includes a pixel array, a plurality of scan lines, a plurality of data lines, a plurality of common lines, a plurality of gate driving units, and a source driving circuit, wherein the pixel array includes a plurality of thin film transistors, a plurality of pixel electrodes, a common electrode, and a display medium layer. Each pixel of the pixel array includes a thin film transistor, wherein a gate of the thin film transistor is connected to one of the scan lines, a source of the thin film transistor is connected to one of the data lines, and a drain of the thin film transistor is connected to one of the pixel electrodes. Each of the gate driving units simultaneously has a scan line driver and a common line driver for respectively providing a scan signal and a common voltage to one of the scan lines and one of the common lines in a same pixel. When each of the gate driving units provides the scan signal to one of the scan lines, the scan signal is only transmitted on the scan line. When each of the gate driving units provides the common voltage to one of the common lines, the common voltage is only transmitted on the common line and is not transmitted on the gate line. Namely, an output terminal of the gate driving unit simultaneously having the scan line driver and the common line driver, the scan line driver is only connected to one end of one of the scan lines and the common line driver is only connected to one end of one of the common lines, and another end of the scan lines and another end of the common lines are not connected to other circuits or drivers (driving units).

The display medium layer is disposed between each of the pixel electrodes and the common electrode. Each of the pixel electrodes, the display medium layer, and the common electrode are sequentially stacked to form a display media capacitor ($C_{LC}$). An insulating layer is disposed between each of the pixel electrodes and one of the common lines. One of the common lines, the insulating layer, and each of the pixel electrodes are sequentially stacked to form a storage capacitor ($C_{ST}$), wherein the pixel electrodes and the common line are disposed on a same substrate, the common electrode is disposed on another substrate, and the above two substrates are oppositely disposed. Namely, the pixel electrodes and the common line are located at one side of the display medium layer, and the common electrode is located at another side of the display medium layer. When the gate driving unit enables one of the scan lines to drive one row of the pixels, this row of the pixels can receive data voltages provided by the source driving circuit through the data lines, so that the pixel electrodes in the pixels can respectively be charged to a voltage level after the enabling period is ended. However, during a same frame period, when enabling of the scan line corresponding to the row of the pixels is ended, the row of the pixels can receive the common voltage from the corresponding common line, so that the pixel electrode of the pixel can be coupled to a predetermined voltage level.

Therefore, according to the CC driving method, the voltage level of the pixel electrode can be adjusted to the predetermined voltage level during a non-enabling period of the scan line, so that the problem of insufficient charging of the pixel electrodes due to a short enabling period can be resolved. However, the gate driving units located outside the pixel array are not only implemented by complicated logic gates, but also occupy a great amount of layout spaces on the glass substrate, so that a design requirement of a slim border cannot be achieved.

SUMMARY OF THE INVENTION

The present invention is directed to a display, which can execute a capacitive coupled (CC) driving method without applying a complicated circuit design, and has design advantage of a slim border.

The present invention provides a display including a pixel array, a plurality of scan lines, at least one dummy scan line, a plurality of data lines, a plurality of common lines, a plurality of common line driving units, a plurality of gate driving units, and a source driving circuit. The pixel array includes a plurality of pixels arranged in an array, wherein each of the scan lines is electrically connected to one row of the pixels, each of the data lines is electrically connected to one column of the pixels, and the source driving circuit is electrically connected to the data lines. The dummy scan line is disposed in at least one side of the scan lines, and the dummy scan line is not electrically connected to the pixels. Each of the common lines is capacitively coupled to one row of the pixels, and the common lines are electrically insulated from each other. Each of the common line driving units is electrically connected to one of the common lines. The common line driving units and the gate driving units are respectively disposed at two opposite sides of the pixel array. An $(i+n)^{th}$ scan line is electrically connected to an $(i+n)^{th}$ row of the pixels, and an $i^{th}$ common line is capacitively coupled to an $i^{th}$ row of the pixels. Moreover, each of the gate driving units is electrically connected to one of the common line driving units through an $i^{th}$ scan line or the dummy scan line, so as to change a voltage of an $(i+n)^{th}$ or an $(i-n)^{th}$ common line, wherein i and n are all positive integers, and $i>n\geqq 1$.

The present invention provides another display including a pixel array, a plurality of scan lines, at least one dummy scan line, a plurality of data lines, a plurality of common lines, a plurality of common line driving units, a plurality of gate driving units, and a source driving circuit. The pixel array includes a plurality of pixels arranged in an array, wherein each of the scan lines is electrically connected to one row of the pixels, each of the data lines is electrically connected to one column of the pixels, and the source driving circuit is electrically connected to the data lines. The dummy scan line is disposed in at least one side of the scan lines, and the dummy scan line is not electrically connected to the pixels. Each of the common lines is capacitively coupled to one row of the pixels, and the common lines are electrically insulated from each other. Each of the common line driving units is electrically connected to one of the common lines, wherein each of the common line driving units includes a switch. The common line driving units and the gate driving units are respectively disposed at two opposite sides of the pixel array, and an $(i+n)^{th}$ scan line is electrically connected to an $(i+n)^{th}$ row of the pixels, and an $i^{th}$ common line is capacitively coupled to an $i^{th}$ row of the pixels. Moreover, an $i^{th}$ common line driving unit is connected to the $i^{th}$ common line, and each of the gate driving unit is connected to the switch corresponding to an $(i+n)^{th}$ common line driving unit and the switch corresponding to an $(i-n)^{th}$ common line driving unit through an $i^{th}$ scan line or the dummy scan line, so as to change a voltage of an $(i+n)^{th}$ or an $(i-n)^{th}$ common line, wherein i and n are all positive integers, and $i>n\geqq 1$.

The present invention provides an electro-optical apparatus including the aforementioned display.

The electro-optical apparatus and the display thereof can execute the CC driving method without using the conventional complicated gate driving units, and according to a design among the scan lines, the dummy scan line, the common line driving units and the gate driving units, a slim border design can be achieved by the invention.

In order to make the aforementioned and other features and advantages of the present invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
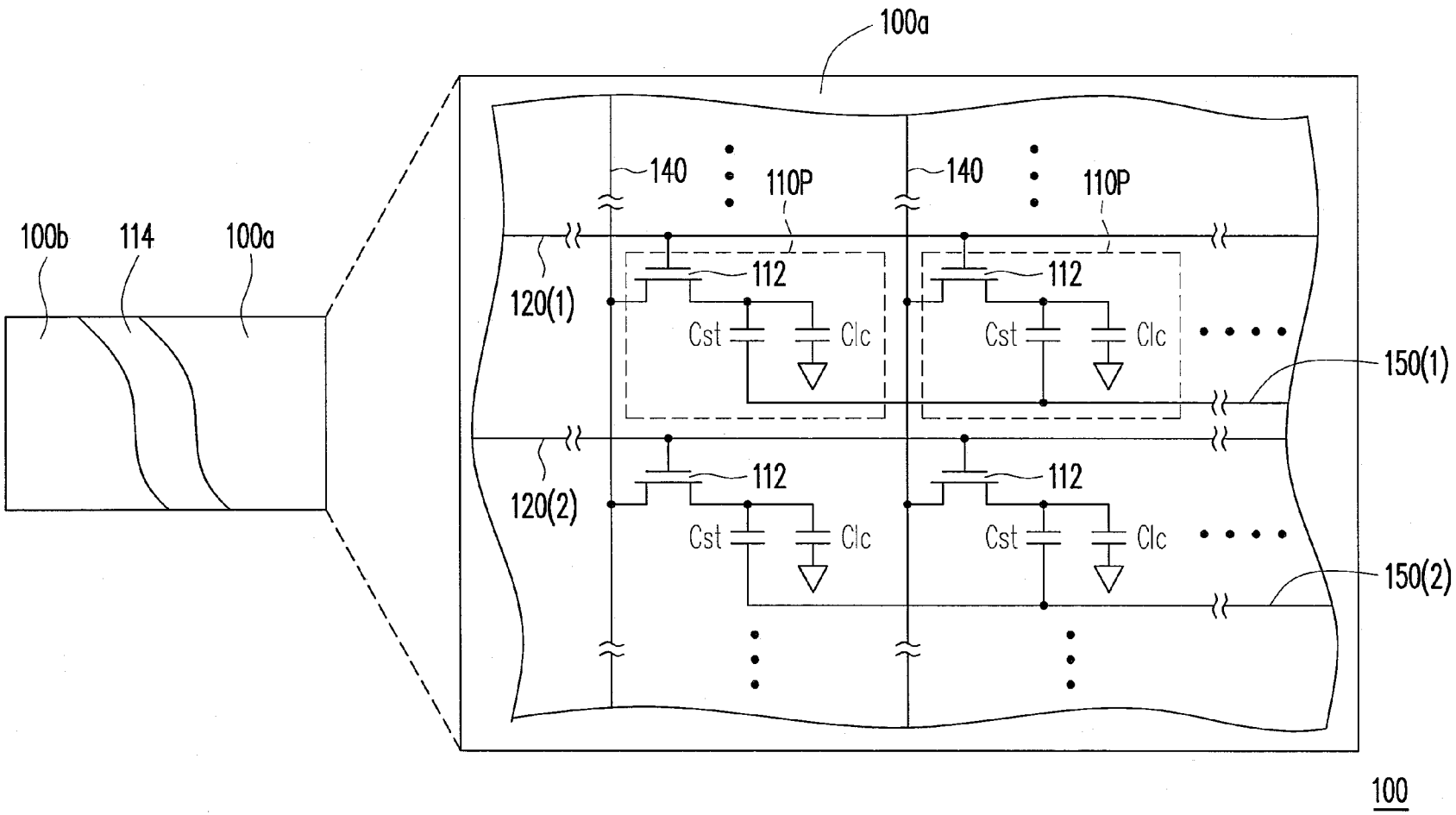
FIG. 1A is a top view of a display and a partial equivalent circuit diagram of a pixel array of the display according to an embodiment of the present invention.

FIG. 1A is a top view of a display and a partial equivalent circuit diagram of a pixel array thereof according to an embodiment of the present invention. Referring to FIG. 1A, the pixel array 110 of the display 100 of the present embodiment includes a plurality of pixels 110P arranged in an array. In detail, the pixel array 110 includes a plurality of active devices 112, a plurality of pixel electrodes (not shown), a common electrode (not shown) and a display medium layer 114. In the present embodiment, the active devices 112 and the pixel electrodes are, for example, disposed on an active device array substrate 100*a*, the common electrode is, for example, disposed on a counter substrate 100*b* above the pixel electrodes, and the display medium layer 114 is disposed between the active device array substrate 100*a* and the counter substrate 100*b*, and is located between the pixel electrodes and the common electrode. Wherein, the pixel array 110 includes a plurality of the active devices 112, a plurality of the pixel electrodes (not shown) and the common electrode (not shown), which are all disposed on the substrate 110*a*, and the pixel array 110 can be referred to as an active device array layer, while the substrate 110*a* can be referred to as an active device array substrate.

In the present embodiment, a gate of each of the active device 112 is electrically connected to one of the scan lines 120(1), 120(2), . . . , and a source of each of the active device 112 is electrically connected to one of the data lines 140. Moreover, a drain of each of the active device 112 is electrically connected to one of the pixel electrodes. An insulating layer (not shown) is disposed between each of the pixel electrodes and one of the common lines 150(1), 150(2), . . . . One of the common lines 150(1), 150(2), . . . , the insulating layer, and each of the pixel electrodes are sequentially stacked and are capacitively coupled to form a storage capacitor Cst. A part of the display medium layer 114 is disposed between each of the pixel electrodes and a part of the common electrode. Each of the pixel electrodes, a part of the display medium layer 114, and a part of the common electrode are sequentially stacked to form a display media capacitor Clc, wherein the common lines 150(1), 150(2), . . . (disposed on the active device array substrate 100*a*) and the common electrode (disposed on the counter substrate 100*b*) are respectively located at two sides of the display medium layer 114.

Figure 1B:
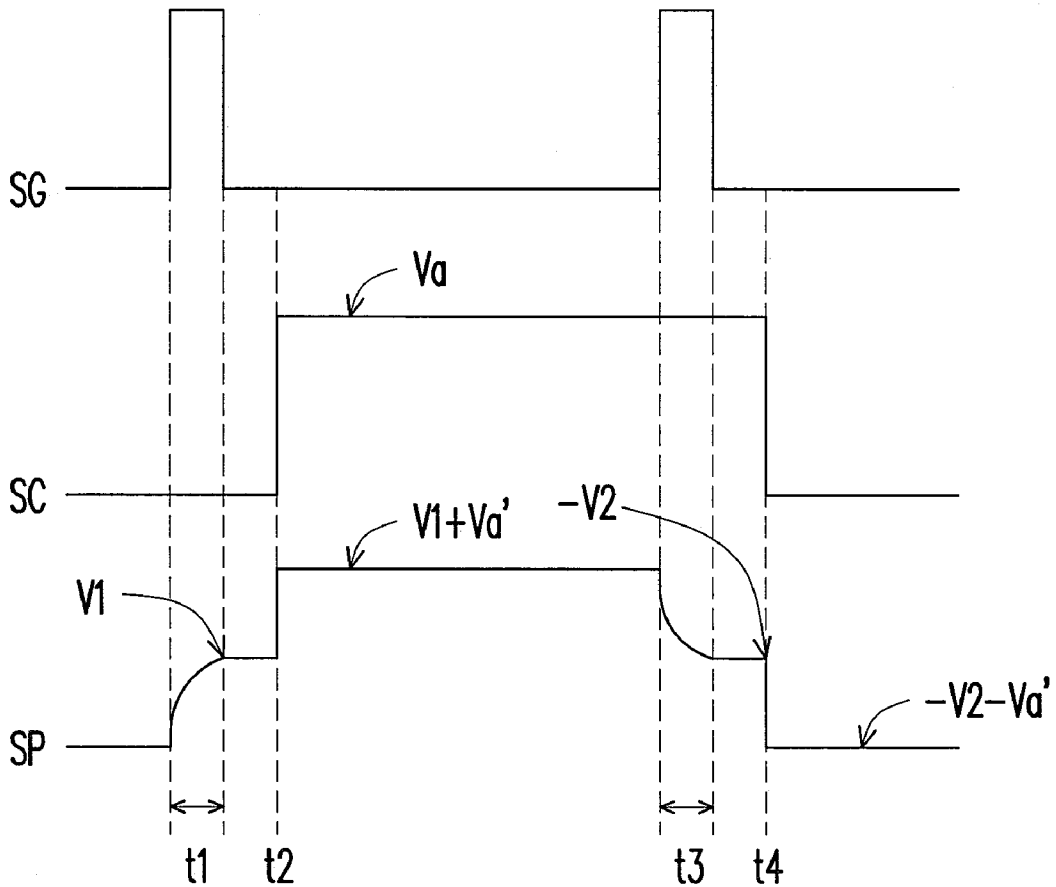
FIG. 1B is a driving waveform diagram of a display according to an embodiment of the present invention.

FIG. 1B is a driving waveform diagram of a display according to an embodiment of the present invention, wherein a signal waveform of the scan line 120(1) is SG, a signal waveform of the common line 150(1) is SC, and a signal waveform of the pixel electrode in the $1^{st}$ row and the $1^{st}$ column of the pixel 110P is SP. Moreover, preferably, a polarity inversion driving method is used to avoid a liquid crystal polarization phenomenon, i.e. the liquid crystal is driven by a voltage of different polarities during two continuous frame periods, and the polarity inversion can be achieved as a polarity of the voltage of the pixel electrode is substantially different to a polarity of the voltage of the common electrode.

Referring to FIG. 1A and FIG. 1B, in the present embodiment, during a period t1, the scan line 120(1) is enabled, and the common line 150(1) has a low voltage level, i.e. has a voltage level lower than that of the scan line 120(1), for example 0V (volt). Now, the pixel electrode in the $1^{st}$ row and the $1^{st}$ column of the pixel 110P is, for example, charged to a voltage V1. Then, after enabling of the scan line 120(1) is ended, the common line 150(1) has a high voltage level during a period t2, i.e. has a voltage level (for example, Va) higher than the voltage level of the common line 150(1) during the period t1, which can boost the voltage of the pixel electrode to (V1+Va') through the storage capacitor Cst. Wherein, the period t1 plus the period t2 is one frame period.

Thereafter, during a period t3 of a next frame period, the scan line 120(1) is again enabled, though the common line 150(1) still has the high voltage level, i.e. has the voltage level (for example, Va) higher than the voltage level of the common line 150(1) during the period t1. Now, the pixel electrode in the $1^{st}$ row and the $1^{st}$ column of the pixel 110P is, for example, charged to a voltage −V2. Then, after enabling of the scan line 120(1) is ended, the voltage of the common line 150(1) is changed to the low voltage level during a period t4, i.e. changed to a voltage level lower than that of the scan line 120(1), for example, 0V (volt), which can reduce the voltage of the pixel electrode to (−V2−Va') through the storage capacitor Cst.

As described above, according to the capacitive coupled effect between the pixel electrodes and the corresponding common lines 150(1), 150(2), . . . , the voltages of the pixel electrodes can be boosted or reduced by a voltage level after the scan lines 120(1), 120(2), . . . are disabled. Such driving method is generally referred to as a capacitive coupled (CC) driving method. Based on the pixel array 110 of the present embodiment, several displays are provided below for description, though the present invention is not limited to the following embodiments.

First Embodiment

Figure 2A:
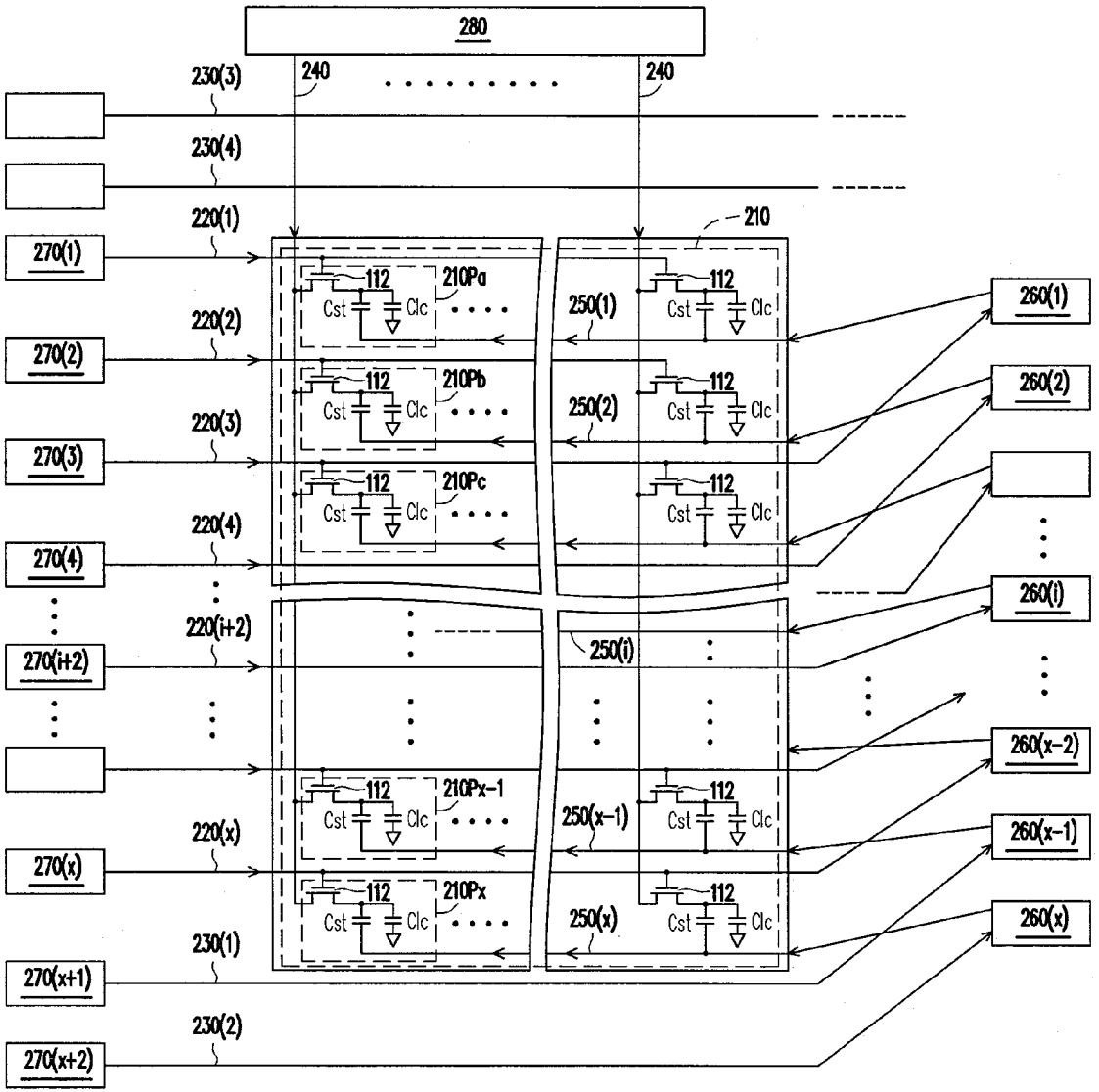
FIG. 2A is a partial top view of a display according to a first embodiment of the present invention.

FIG. 2A is a partial top view of a display according to a first embodiment of the present invention. Referring to FIG. 2A, the display 200 of the present invention includes a pixel array 210, a plurality of scan lines 220(1), 220(2), 220(3), 220(4), . . . , 220(*i*+2), . . . , 220(*x*), at least one of dummy scan lines 230(1), 230(2), a plurality of data lines 240, a plurality of common lines 250(1), 250(2), . . . , 250(*i*), . . . , 250(*x*−1), 250(*x*), a plurality of common line driving units 260(1), 260(2), . . . , 260(*i*), . . . , 260(*x*−2), 260(*x*−1), 260(*x*), a plurality of gate driving units 270(1), 270(2), 270(3), 270(4), . . . , 270(*i*+2), . . . , 270(*x*), 270(*x*+1), 270(*x*+2), and a source driving circuit 280.

In the present embodiment, an extending direction of the data lines 240 is substantially interlaced (for example, substantially perpendicular) to an extending direction of the scan lines 220(1), 220(2), 220(3), 220(4), . . . , 220(*i*+2), . . . , 220(*x*). The extending direction of the scan lines 220(1), 220(2), 220(3), 220(4), . . . , 220(*i*+2), . . . , 220(*x*), an extending direction of the dummy scan lines 230(1), 230(2) and an extending direction of the common lines 250(1), 250(2), . . . , 250(*i*), . . . , 250(*x*−1), 250(*x*) are substantially parallel. In another embodiment, the extending direction of the common lines 250(1), 250(2), . . . , 250(*i*), . . . , 250(*x*−1), 250(*x*) can also be parallel to the extending direction of the data lines 240. In the present embodiment, the extending direction of the common lines 250(1), 250(2), . . . , 250(*i*), . . . , 250(*x*−1), 250(*x*) is substantially interlaced (for example, substantially perpendicular) to the extending direction of the data lines 240.

The pixel array 210 includes a plurality of pixels 210$P_a$, 210$P_b$, 210$P_c$, . . . , 210$P_{x-1}$, 210$P_x$ arranged in an array, wherein each of the scan lines 220(1), 220(2), 220(3), 220(4), . . . , 220(*i*+2), . . . , 220(*x*) is electrically connected to one row of the pixels 210$P_a$, 210$P_b$, 210$P_c$, . . . , 210$P_{x-1}$, 210$P_x$. Each of the data lines 240 electrically connected to the source driving circuit 280 is electrically connected to one column of the pixels 210$P_a$, 210$P_b$, 210$P_c$, . . . , 210$P_{x-1}$, 210$P_x$. Moreover, the common lines 250(1), 250(2), . . . , 250(*i*), . . . , 250(*x*−1), 250(*x*) are mutually insulated, wherein each of the common lines 250(1), 250(2), . . . , 250(*i*), . . . , 250(*x*−1), 250(*x*) is capacitively coupled to one row of the pixels 210$P_a$, 210$P_b$, 210$P_c$, . . . , 210$P_{x-1}$, 210$P_x$. However, a configuration relation among the active devices 112, the pixel electrodes (not shown), the common electrode (not shown) and the display medium layer 114 included in the pixel array 210 is as that shown in FIG. 1A, and detailed descriptions thereof is not repeated.

The gate driving units 270(1), 270(2), 270(3), 270(4), . . . , 270(*i*+2), . . . , 270(*x*) are respectively connected to the scan lines 220(1), 220(2), 220(3), 220(4), . . . , 220(*i*+2), . . . , 220(*x*), so as to achieve a mutually electrical connection effect, and the common lines 250(1), 250(2), . . . , 250(*i*), . . . , 250(*x*−1), 250(*x*) are electrically connected to the common line driving units 260(1), 260(2), . . . , 260(*i*), . . . , 260(*x*−1), 260(*x*), respectively. In the present embodiment, the common lines 250(1), 250(2), . . . , 250(*i*), . . . , 250(*x*−1), 250(*x*) are respectively connected to the common line driving units 260(1), 260(2), . . . , 260(*i*), . . . , 260(*x*−1), 260(*x*), so as to achieve the mutually electrical connection effect.

It should be noticed that the common line driving units 260(1), 260(2), . . . , 260(*i*), . . . , 260(*x*−2), 260(*x*−1), 260(*x*) and the gate driving units 270(1), 270(2), 270(3), 270(4), . . . , 270(*i*+2), . . . , 270(*x*), 270(*x*+1), 270(*x*+2) are respectively located at two opposite sides of the pixel array 210, which avails reducing a layout area of a border area outside a display region, so as to achieve a slim border design of the display 200. Namely, the common line driving units 260(1), 260(2), . . . , 260(*i*), . . . , 260(*x*−2), 260(*x*−1), 260(*x*) and the gate driving units 270(1), 270(2), 270(3), 270(4), . . . , 270(*i*+2), . . . , 270(*x*), 270(*x*+1), 270(*x*+2) are not located in a same driving unit, but are separated and independent.

Moreover, as shown in FIG. 2A, the $3^{rd}$ scan line 220(3) electrically connected to the gate driving unit 270(3) is, for example, electrically connected to the storage capacitor Cst in the $1^{st}$ row of the pixels 210$P_a$ through the common line driving unit 260(1) and the $1^{st}$ common line 250(1). The $4^{th}$ scan line 220(4) electrically connected to the gate driving unit 270(4) is, for example, electrically connected to the storage capacitor Cst in the $2^{nd}$ row of the pixels 210$P_b$ through the common line driving unit 260(2) and the $2^{nd}$ common line 250(2), and the coupling relation of the other gate driving units, scan lines, common line driving units, common lines and pixels can be deduced by analogy. For example, a scan signal output from an output terminal of the gate driving unit 270(3) is transmitted to a gate of the active device 112 in the pixel 210$P_c$ through the $3^{rd}$ scan line 220(3), and is transmitted to an input terminal of the common line driving unit 260(1), and then an output terminal of the common line driving unit 260(1) provides a common voltage to the $1^{st}$ common line 250(1). Operations of the following line sections are similar to the above descriptions, and are shown as arrow directions of FIG. 2A, so that detail descriptions thereof are not repeated. Wherein, the arrows illustrated in FIG. 2A are signal or voltage transmission paths.

In the present embodiment, the gate driving units 270(1), 270(2), 270(3), 270(4), . . . , 270(*i*+2), . . . , 270(*x*) can provide the scan signals to respectively enable the scan lines 220(1), 220(2), 220(3), 220(4), . . . , 220(*i*+2), . . . , 220(*x*), wherein the enabled scan lines enable the corresponding pixels to receive the data signals from the data lines. Moreover, the scan signals can further be transmitted to the corresponding connected common line driving units through the enabled scan lines, so as to drive the corresponding common line driving units. The driven common line driving units can provide common voltages (referred to as first common voltages, hereinafter), and transmit the first common voltages to the corresponding pixels through the corresponding connected common lines, so that the first common voltages can boost or reduce the voltages of the pixel electrodes in the pixels through the storage capacitor Cst in the pixels. Therefore, an image displayed by the display 200 corresponds to a voltage difference between the boosted or reduced voltage of the pixel electrode and a voltage of the common electrode (a second common voltage).

Figure 2B:
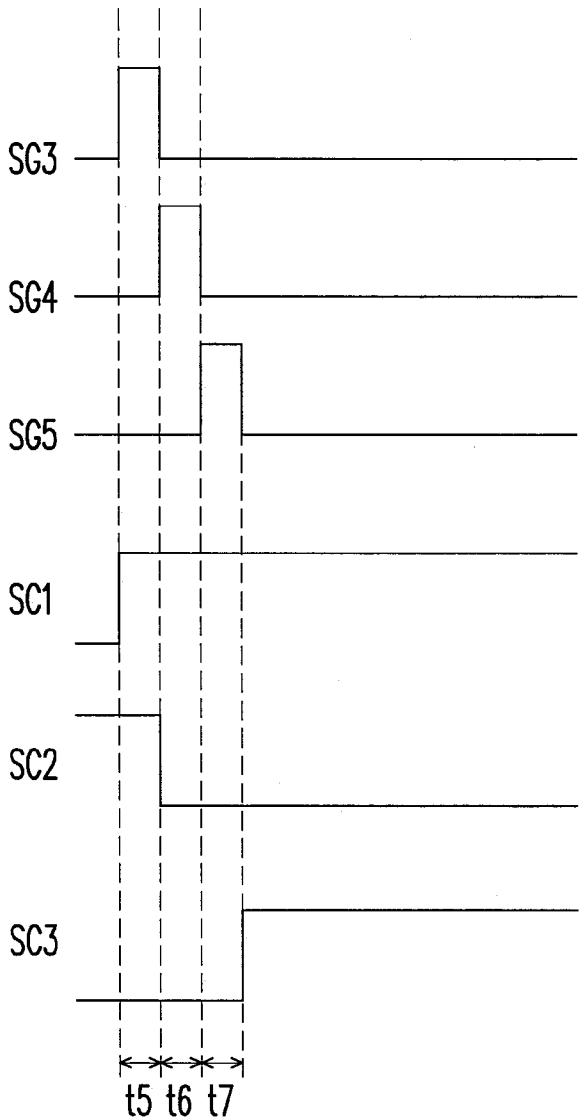
FIG. 2B is a driving waveform diagram of a display of FIG. 2A.

In detail, referring to FIG. 2A and FIG. 2B, assuming the data voltage transmitted by the data line 240 is positive relative to the voltage of the common electrode (referred to as the second common voltage hereinafter, and a voltage waveform thereof is not illustrated) during periods t5 and t7, but is negative during a period t6, and assuming the gate driving units 270(1), 270(2), 270(3), 270(4), . . . , 270(*i*+2), . . . , 270(*x*) sequentially enable the scan lines 220(1), 220(2), 220(3), 220(4), . . . , 220(*i*+2), . . . , 220(*x*). In another embodiment, the waveforms during the periods t5 and t7 can also be negative, and the waveform during the period t6 can also be positively. Namely, a polarity of the waveform during the period t6 is different to a polarity of the waveforms during the periods t5 and t7.

When the gate driving unit 270(3) transmits the scan signal SG3 to enable the $3^{rd}$ scan line 220(3) during the period t5, the scan signal SG3 further drives the common line driving unit 260(1). Now, the driven common line driving unit 260(1) provides a first common voltage SC1 (which is, for example, positive relative to the second common voltage) to the $1^{st}$ common line 250(1), and the first common voltage SC1 can boost the voltages of the pixel electrodes in the $1^{st}$ row of the pixels 210$P_a$ through the storage capacitors Cst in the $1^{st}$ row of the pixels 210$P_a$.

Then, during the period t6, the gate driving unit 270(3) stops enabling the scan line 220(3), and the gate driving unit 270(4) transmits the scan signal SG4 to enable the $4^{th}$ scan line 220(4), so as to drives the common line driving unit 260(2). Now, the driven common line driving unit 260(2) provides a first common voltage SC2 (which is, for example, negative relative to the second common voltage) to the $2^{nd}$ common line 250(2), and the first common voltage SC2 can reduce the voltages of the pixel electrodes in the $2^{nd}$ row of the pixels 210$P_b$ through the storage capacitors Cst in the $2^{nd}$ row of the pixels 210$P_b$.

During the period t7, the scan line 220(4) is disabled, and a next scan line (the $5^{th}$ scan line, which is not illustrated) is enabled, and the scan signal SG5 transmitted by the $5^{th}$ scan line can drive the corresponding common line driving unit, so that the voltages of the pixel electrodes in the $3^{rd}$ row of the pixels 210$P_c$ can be boosted by the first common voltage SC3 (which is negative relative to the second common voltage) provided by the driven common line driving unit. The other driving steps can be deduced by analogy, and detail descriptions thereof are not repeated.

According to the above descriptions, it is known that at a same time point, the enabled scan line and the driven common line respectively correspond to different row of the pixels, and during a same frame period, a time point corresponding to a voltage variation of an $i^{th}$ common line 250(*i*) is later than a time point corresponding to a voltage variation of an $i^{th}$ scan line.

In the present embodiment, when the scan line 220(*i*+2) is enabled, the driven common line is 250(*i*). Therefore, a difference between a row number of the pixels corresponding to the simultaneously enabled scan lines and a row number of the pixels corresponding to the driven common lines is 2.

Based on the above design, at least two dummy scan lines 230(1) and 230(2) not electrically connected to the pixels 210$P_a$, 210$P_b$, 210$P_c$, . . . , 210$P_{x-1}$, 210$P_x$ are configured at a side of the scan line 220(*x*). For example, the dummy scan lines 230(1) and 230(2) are not connected to the gate of the active device 112, so that the last scan line 220(*x*) is located between the dummy scan lines 230(1) and 230(2) and the scan line 220(*x*−1). For example, the last scan line 220(*x*) is located at an inner side of the dummy scan lines 230(1) and 230(2), or the last scan line 220(*x*) is located between the dummy scan lines 230(1) and 230(2) or is located at other suitable positions. Therefore, after enabling of the last scan line 220(*x*) is stopped, the last two rows of the common lines 250(*x*−1) and 250(*x*) can still be sequentially driven, wherein the dummy scan lines 230(1) and 230(2) are electrically connected to the gate driving units 270(*x*+1) and 270(*x*+2), respectively, and are electrically connected to the common lines 250(*x*−1) and 250(*x*) through the common line driving units 260(*x*−1) and 260(*x*), respectively. However, the dummy scan lines 230(1) and 230(2) are mainly used for providing the driving signals required by the common line driving units 260(*x*−1) and 260(*x*), so that the side where the dummy scan lines 230(1) and 230(2) are configured near the scan lines 220(1), 220(2), 220(3), 220(4), . . . , 220(*i*+2), . . . , 220(*x*) is not limited by the present invention.

It should be noticed that a number of the dummy scan lines is determined according to a demand of an actual product, which is not limited by the present invention. In the present embodiment, the number of the dummy scan lines is mainly determined according to a configuration relation between the scan lines and the common lines, i.e. a configuration relation that the scan line 220(*i*+2) is electrically connected to the common line 250(*i*) through the corresponding common line driving unit, so that at least two dummy scan lines 230(1) and 230(2) are disposed at a side of the scan line 220(*x*). However, in an actual application, a same number of the dummy scan lines are probably disposed at a side of the scan line 220(1) according to a demand of the product, for example, at least two dummy scan lines 230(3) and 230(4) are added. Moreover, in another embodiment, if a scan line 220(*i*+*n*) is electrically connected to the common line 250(*i*) through the corresponding common line driving unit, n dummy scan lines are then configured, wherein n is a positive integer, and $i>n\geqq 1$. In a preferred embodiment, $1\leqq n\leqq 4$.

According to the above descriptions, it is known that in the present embodiment, two ends of each of the scan lines are electrically connected to the corresponding gate driving unit and the corresponding common line driving unit, respectively. Moreover, one end of each of the common lines is electrically connected to the corresponding common line driving unit, and another end thereof is not electrically connected to any gate driving unit, but is capacitively coupled to the corresponding pixel. Compared to the conventional design in the description of prior art that the gate driving units are implemented by the complicated logic gates, and each of the gate driving unit simultaneously has a scan line driver and a common line driver for respectively connecting the scan line and the common line, so as to respectively drive the scan line during the enabling period and drive the common line during the non-enabling period, the present embodiment has an advantage of a simple design.

Second Embodiment

The spirit of the present embodiment is similar to that of the first embodiment, and related descriptions of the pixels are similar as the descriptions of the pixels shown in FIG. 1A. A difference between the present embodiment and the first embodiment is that a sequence for sequentially enabling the scan lines 220(*x*), 220(*x*−1), . . . , 220(2), 220(1) and the dummy scan lines 330(2) and 330(1) is exactly opposite to the enabling sequence of the first embodiment, so that configurations of the elements in the display 300 is slightly different to that in the display 200, as that shown in FIG. 3. However, the same or the like reference numerals in both of the present embodiment and the first embodiment refer to the same or the like elements, so that detail descriptions thereof are not repeated.

In the present embodiment, the display 300 includes a pixel array 210, a plurality of scan lines 220(1), 220(2), . . . , 220($x$−1), 220($x$), at least one of dummy scan lines 330(1), 330(2), a plurality of data lines 240, a plurality of common lines 350(1), 350(2), 350(3), . . . , 350($x$−1), 350($x$), a plurality of common line driving units 260(1), 260(2), 260(3), 260(4), . . . , 260($x$−1), 260($x$), a plurality of gate driving units 370(1), 370(2), 270(1), 270(2), . . . , 270($x$−1), 270($x$) and a source driving circuit 280.

Figure 3:
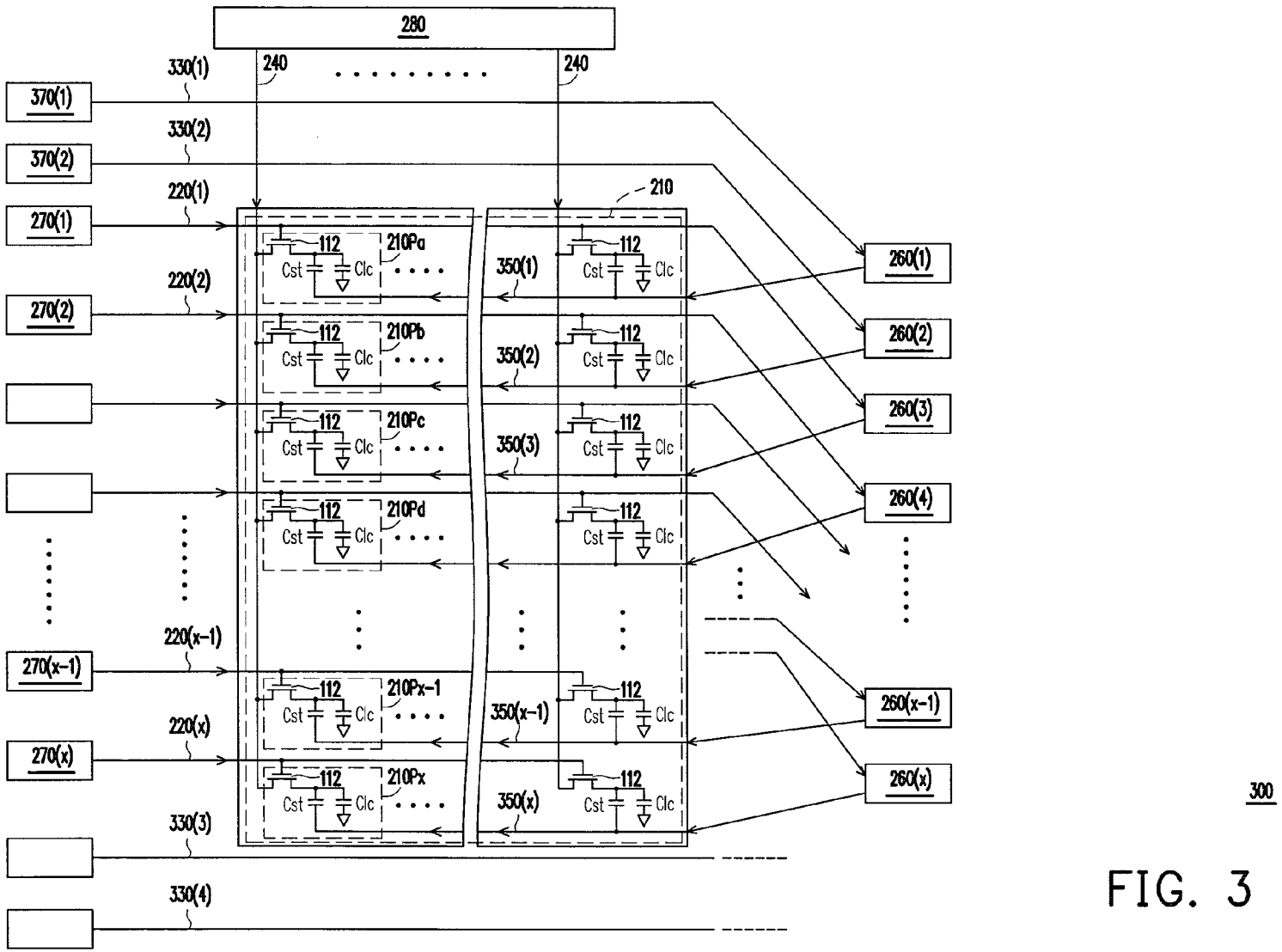
FIG. 3 is a partial top view of a display according to a second embodiment of the present invention.

According to FIG. 3, it is known that the common line driving units 260(1), 260(2), 260(3), 260(4), . . . , 260($x$−1), 260($x$) and the gate driving units 370(1), 370(2), 270(1), 270(2), . . . , 270($x$−1), 270($x$) are respectively located at two opposite sides of the pixel array 210, which avails reducing a layout area of the border area outside the display region, so that the display 300 also has the design advantage of the slim border.

In the present embodiment, the common lines 350(1), 350(2), 350(3), . . . , 350($x$−1), 350($x$) are respectively connected to the common line driving units 260(1), 260(2), 260(3), . . . , 260($x$−1), 260($x$) to achieve a mutual electrical connection effect, so that the 1$^{st}$ scan line 220(1) electrically connected to the gate driving unit 270(1) can be electrically connected to the storage capacitors Cst in the 3$^{rd}$ row of the pixels 210$P_c$ through the common line driving unit 260(3) and the common line 350(1). Similarly, the 2$^{nd}$ scan line 220(2) electrically connected to the gate driving unit 270(2) can be electrically connected to the storage capacitors Cst in the 4$^{th}$ row of the pixels 210$P_d$ through the common line driving unit 260(4) and the common line 350(2). The coupling relation of the other gate driving units, scan lines, common line driving units, common lines and pixels can be deduced by analogy. For example, a scan signal output from an output terminal of the gate driving unit 270(1) is transmitted to the gate of the active device 112 in the pixel 210$P_a$ through the 1$^{st}$ scan line 220(1), and is transmitted to an input terminal of the common line driving unit 260(3), and then an output terminal of the common line driving unit 260(3) provides a common voltage to the 3$^{rd}$ common line 350(3), and operations of the following line sections are similar to the above descriptions, and are shown as arrow directions of FIG. 3, so that detail descriptions thereof are not repeated. Wherein, the arrows illustrated in FIG. 3 are the signal or voltage transmission paths.

In the present embodiment, the gate driving units 270(1), 270(2), 270(3), 270(4), . . . , 270($i$+2), . . . , 270($x$) can provide the scan signals to respectively enable the scan lines 220(1), 220(2), 220(3), 220(4), . . . , 220($i$+2), . . . , 220($x$). Moreover, the scan signals can further be transmitted to the corresponding connected common line driving units through the enabled scan lines, so as to drive the corresponding common line driving units. Therefore, the driven common line driving units can drive the corresponding common lines to boost or reduce the voltages of the pixel electrodes in the corresponding pixels, which is similar as that described in the first embodiment, and therefore detail descriptions thereof are not repeated.

Regarding a structure of the display 300, when the gate driving units 270($x$), 270($x$−1), . . . , 270(2), 270(1) sequentially enable the scan lines 220($x$), 220($x$−1), . . . , 220(2), 220(1), it can be deduced that during a same frame period, a time point corresponding to a voltage variation of the 1$^{st}$ common line 350(1) is earlier than a time point corresponding to a voltage variation of the 1$^{st}$ scan line 220(1), a time point corresponding to a voltage variation of the 2$^{nd}$ common line 350(2) is earlier than a time point corresponding to a voltage variation of the 2$^{nd}$ scan line 220(2), and so on. Namely, during the same frame period, a time point corresponding to a voltage variation of an i$^{th}$ common line in the display 300 is earlier than a time point corresponding to a voltage variation of an i$^{th}$ scan line.

In the present embodiment, a difference between a row number of the pixels corresponding to the simultaneously enabled scan lines and a row number of the pixels corresponding to the driven common lines is 2. Based on the above design, at least two dummy scan lines 330(1) and 330(2) not electrically connected to the pixels 210$P_a$, 210$P_b$, 210$P_c$, . . . , 210$P_{x-1}$, 210$P_x$ are configured at a side of the scan line 220(1). For example, the dummy scan lines 330(1) and 330(2) are not connected to the gate of the active device 112, so that the 1$^{st}$ scan line 220(1) is located between the dummy scan lines 330(1) and 330(2) and the 2$^{nd}$ scan line 220(2). For example, the 1$^{st}$ scan line 220(1) is located at an inner side of the dummy scan lines 330(1) and 330(2), or the 1$^{st}$ scan line 220(1) is located between the dummy scan lines 330(1) and 330(2) or is located at other suitable positions. Therefore, before the 1$^{st}$ scan line 220(1) drives the common line 350(3) during the enabling period of the 1$^{st}$ scan line 220(1), it can sequentially drive the common lines 350(1) and 350(2) first. Wherein, the dummy scan lines 330(1) and 330(2) are electrically connected to the gate driving units 370(1) and 370(2), respectively, and are electrically connected to the common lines 350(1) and 350(2) through the common line driving units 260(1) and 260(2), respectively.

In the present embodiment, the dummy scan lines 330(1) and 330(2) are mainly used for providing the driving signals required by the common line driving units 260(1) and 260(2), so that the side where the dummy scan lines 230(1) and 230(2) are configured near the scan lines 220(1), 220(2), 220(3), 220(4), . . . , 220($i$+2), . . . , 220($x$) is not limited by the present invention, and a quantity of the dummy scan lines is neither limited by the present invention. For example, as shown in FIG. 3, at least two dummy scan lines 330(3) and 330(4) are also configured at a side of the scan line 220($x$), which is an example of multiple different designs.

Third Embodiment

Figure 4:
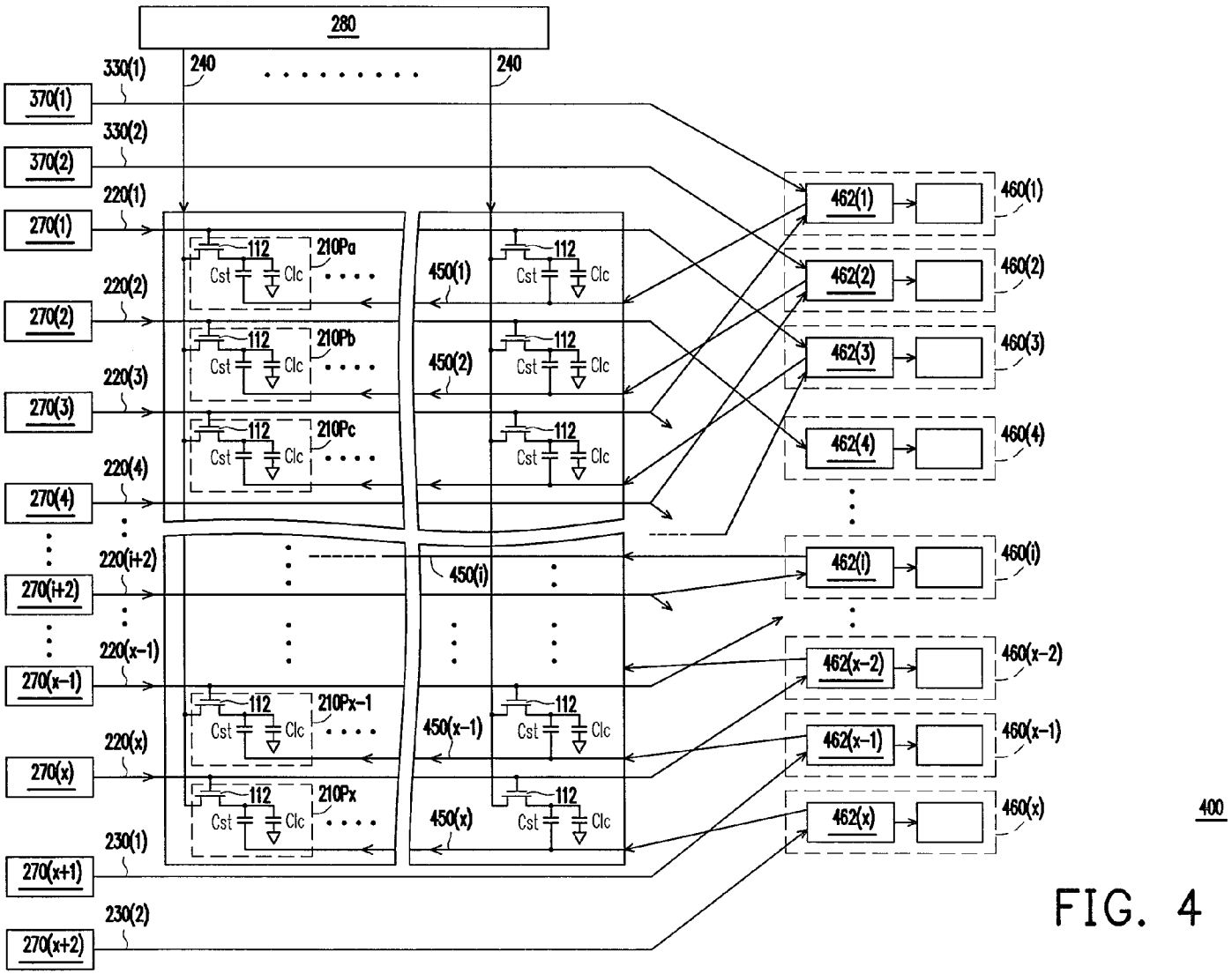
FIG. 4 is a partial top view of a display according to a third embodiment of the present invention.

The spirit of the present embodiment is similar to that of the first and the second embodiments, though in the present embodiment, layouts of the displays of the first and the second embodiments are integrated to form a display 400 of FIG. 4. As shown in FIG. 4, the display 400 has an even number of dummy scan lines (for example, 330(1), 330(2), 230(1), 230(2)). The 1$^{st}$ scan line 220(1) is located between the dummy scan lines 330(1) and 330(2) and the 2$^{nd}$ scan line 220(2). For example, the 1$^{st}$ scan line 220(1) is located at an inner side of the dummy scan lines 330(1) and 330(2), or the 1$^{st}$ scan line 220(1) is located between the dummy scan lines 330(1) and 330(2) or is located at other suitable positions. Moreover, the last scan line 220($x$) is located between the dummy scan lines 230(1) and 230(2) and the scan line 220($x$−1). For example, the last scan line 220($x$) is located at an inner side of the dummy scan lines 230(1) and 230(2), or the last scan line 220($x$) is located between the dummy scan lines 230(1) and 230(2) or is located at other suitable positions.

The same or the like reference numerals in both of the present embodiment and the aforementioned embodiments refer to the same or the like elements, so that detail descriptions thereof are not repeated. Moreover, for simplicity's sake, only different parts between the present embodiment and the first and the second embodiments are described below.

Referring to FIG. 4, the common line driving units 460(1), 460(2), 460(3), 460(4), . . . , 460(*i*), . . . , 460(*x*−2), 460(*x*−1), 460(*x*) respectively includes switches 462(1), 462(2), 462(3), 462(4), . . . , 462(*i*), . . . , 462(*x*−2), 462(*x*−1), 462(*x*), wherein the common line driving units 460(1), 460(2), . . . , 460(*i*), . . . , 460(*x*−1), 460(*x*) are respectively connected to the common lines 450(1), 450(2), . . . , 450(*i*), . . . , 450(*x*−1), 450(*x*), and the gate driving units 370(1), 370(2), 270(1), 270(2), 270(3), 270(4), . . . , 270(*i*+2), . . . , 270(*x*), 270(*x*+1), 270(*x*+2) are electrically connected to the corresponding switches.

As described above, the gate driving units 370(1) and 370(2) are electrically connected to the switches 462(1) and 462(2) corresponding to the common line driving units 460(1) and 460(2) through the dummy scan lines 330(1) and 330(2). Moreover, the gate driving units 270(1), 270(2), . . . are electrically connected to the switches 462(3), 462(4), . . . corresponding to the common line driving units 460(3), 460(4), . . . through the scan lines 230(1), 230(2), . . . . Wherein, the arrows illustrated in FIG. 4 are the signal or voltage transmission paths. According to the above structure, coupling relations among the gate driving units, the (dummy) scan lines and the common line driving units of the present embodiment are similar to that of the structure of FIG. 3 in the second embodiment.

On the other hand, the gate driving units 270(3), 270(4), . . . , 270(*i*+2), . . . , 270(*x*) are electrically connected to the switches 462(1), 462(2), . . . , 462(*i*), . . . , 462(*x*−2) corresponding to the common line driving units 460(1), 460(2), . . . , 460(*i*), . . . , 460(*x*−2) through the scan lines 220(3), 220(4), . . . 220(*i*+2), . . . , 220(*x*). Moreover, the gate driving units 270(*x*+1) and 270(*x*+2) are electrically connected to the switches 462(*x*−1) and 462(*x*) corresponding to the common line driving units 460(*x*−1) and 460(*x*) through the dummy scan lines 230(1) and 230(2). Wherein, the arrows illustrated in FIG. 4 are the signal or voltage transmission paths. According to the above structure, coupling relations among the gate driving units, the (dummy) scan lines and the common line driving units of the present embodiment are similar to that of the structure of FIG. 2A in the first embodiment.

In the present embodiment, though each of the common line driving units (for example, 460(1)) can be electrically connected to two scan lines, or can be electrically connected to one dummy scan line (for example, 330(1)) and one scan line (for example, 220(1)), according to switching operations of the switches 462(1), 462(2), 462(3), 462(4), . . . , 462(*i*), . . . , 462(*x*−2), 462(*x*−1), 462(*x*) in the common line driving units 460(1), 460(2), 460(3), 460(4), . . . , 460(*i*), . . . , 460(*x*−2), 460(*x*−1), 460(*x*), each of the common line driving units 460(1), 460(2), 460(3), 460(4), . . . , 460(*i*), . . . , 460(*x*−2), 460(*x*−1), 460(*x*) is substantially connected to one of the scan lines or one of the dummy scan lines, so as to display images on the display 400.

For example, assuming the gate driving units 270(1), 270(2), 270(3), 270(4), . . . , 270(*i*+2), . . . , 270(*x*), 270(*x*+1), 270(*x*+2) sequentially enable the scan lines 220(1), 220(2), 220(3), 220(4), . . . , 220(*i*+2), . . . , 220(*x*) and the dummy scan lines 230(1) and 230(2), the switches 462(1), 462(2), 462(3), 462(4), . . . , 462(*i*), . . . , 462(*x*−2), 462(*x*−1), 462(*x*) can selectively connect the gate driving units 370(1), 370(2), 270(1), 270(2), . . . only to the common line driving units 460(1), 460(2), . . . , 460(*i*), . . . , 460(*x*−2), 460(*x*−1), 460(*x*) respectively through the scan lines 220(3), 220(4), . . . , 220(*i*+2), . . . , 220(*x*) and the dummy scan lines 230(1) and 230(2), so that the gate driving units 270(1), 270(2), . . . , 270(*i*), . . . , 270(*x*−1), 270(*x*) can change the voltages of the common lines 450(1), 450(2), . . . , 450(*i*), . . . , 450(*x*−1), 450(*x*). However, such driving method is similar to the driving method of the second embodiment, so that the second embodiment can be referred for further descriptions, and therefore detail descriptions thereof are not repeated.

In another embodiment, assuming the gate driving units 270(*x*), 270(*x*−1), . . . , 270(2), 270(1), 370(2), 370(1) sequentially enable the scan lines 220(*x*), 220(*x*−1), . . . , 220(2), 220(1) and the dummy scan lines 330(2) and 330(1), the switches 462(1), 462(2), 462(3), 462(4), . . . , 462(*i*), . . . , 462(*x*−2), 462(*x*−1), 462(*x*) can selectively connect the gate driving units 370(1), 370(2), 270(1), 270(2), . . . only to the common line driving units 460(1), 460(2), 460(3), 460(4), . . . respectively through the dummy scan lines 330(1), 330(2) and the scan lines 220(1), 220(2), . . . , so that the gate driving units 370(1), 370(2), . . . , 270(*x*−1), 270(*x*), . . . can change the voltages of the common lines 450(1), 450(2), . . . , 450(*x*−1), 450(*x*). However, such driving method is similar to the driving method of the first embodiment, so that the first embodiment can be referred for further descriptions, and therefore detail descriptions thereof are not repeated.

According to the above descriptions, it is known that the display 400 of the present embodiment includes the structures of both of the display 200 of the first embodiment and the display 300 of the second embodiment. By configuring a switch to each of the common line driving units, one of the structures can be selectively adopted. Therefore, the display 400 not only has the design advantage of the slim border, but also has an advantage of adjustability.

It should be noticed that the displays 100, 200, 300 and 400 of the above embodiments can be non self-luminescent displays, self-luminescent displays or hybrid displays (which is also referred to as semi self-luminescent displays). In detail, if a material of the display medium layer 114 (shown in FIG. 1A) is a liquid crystal material or an electrophoresis material, the displays 100, 200, 300 and 400 are referred to as liquid crystal or electrophoresis display panels (i.e. the non self-luminescent displays), for example, transmissive display panels, trans-reflective display panels, reflective display panels, color filter on array display panels, array on color filter display panels, vertical alignment (VA) display panels, in plane switch (IPS) display panels, multi-domain vertical alignment (MVA) display panels, twist nematic (TN) display panels, super twist nematic (STN) display panels, patterned-silt vertical alignment (PVA) display panels, super patterned-silt vertical alignment (S-PVA) display panels, advance super view (ASV) display panels, fringe field switching (FFS) display panels, continuous pinwheel alignment (CPA) display panels, axially symmetric aligned micro-cell mode (ASM) display panels, optical compensation banded (OCB) display panels, super in plane switching (S-IPS) display panels, advanced super in plane switching (AS-IPS) display panels, ultra-fringe field switching (UFFS) display panels, polymer stabilized alignment display panels, dual-view display panels, triple-view display panels, three-dimensional display panels, blue phase display panels or other types of display panels or combinations thereof. If the material of the display medium layer 114 is an electro-luminescent material, the displays 100, 200, 300 and 400 are referred to as electro-luminescent display panels (i.e. the self-luminescent displays), for example, a phosphorescence electro-luminescent display panel, a fluorescence electro-luminescent display panel or combinations thereof, and the electro-luminescent material can be organic materials, inorganic materials or combinations thereof. Moreover, size of molecules of the aforementioned materials includes small molecules, polymers or combinations thereof. If the display medium layer 114 simultaneously includes the liquid crystal material and the electro-luminescent material or simultaneously includes the electrophoresis material and the electro-luminescent material, the displays 100, 200, 300 and 400 are then referred to as hybrid display panels or semi self-luminescent display panels.

Figure 5:
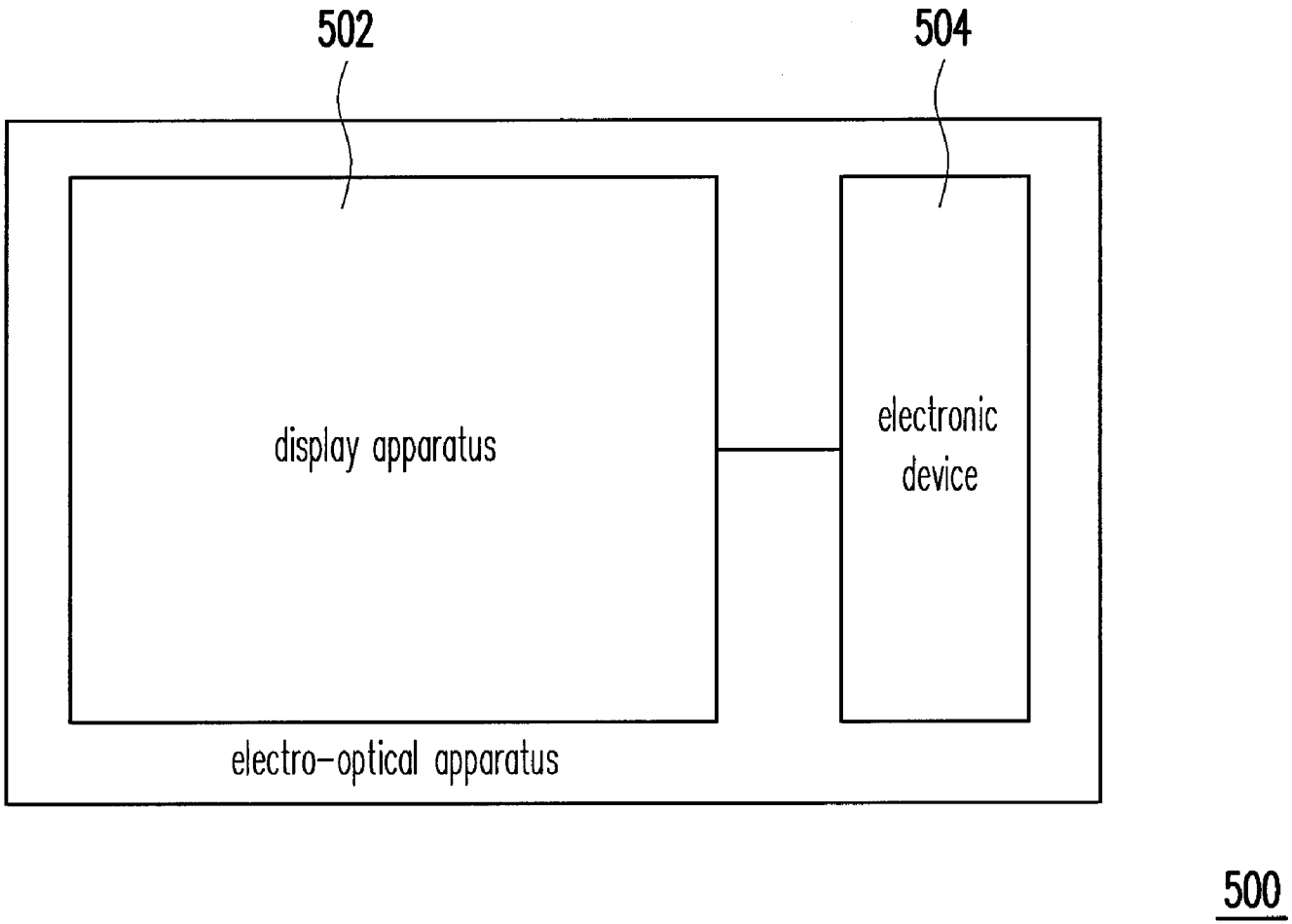
FIG. 5 is a schematic diagram of an electro-optical apparatus according to an embodiment of the present invention.

However, the structures of the displays 100, 200, 300 and 400 can also be applied to a structure of an electro-optical apparatus, and the structure of the electro-optical apparatus is as that shown in FIG. 5. FIG. 5 is a schematic diagram of an electro-optical apparatus according to an embodiment of the present invention. Referring to FIG. 5, the electro-optical apparatus 500 of the present embodiment includes a display apparatus 502 and an electronic device 504 electrically connected to the display apparatus 502. The electronic device 504 can be a control device, an operation device, a processing device, an input device, a memory device, a driving device, a luminescent device, a protection device, a sensing device, a detecting device, or other devices or combinations thereof. The electro-optical apparatus 500 can be a portable product (such as a cell phone, a digital camera, a photo camera, a notebook computer, a game machine, a watch, a music player, an email transceiver, a map navigator, a digital camera or similar products), a video-audio product (such as a video-audio player or similar products), a screen, a television, a display board, or a panel within a projector etc.

In summary, the CC driving method executed by the electro-optical apparatus and the display thereof is achieved since that the pixels corresponding to the enabled scan lines or the dummy scan lines are different to the pixels corresponding to the driven common lines during a same frame period, and since the common line driving units and the gate driving units are respectively disposed at two opposite sides of the pixel array, the electro-optical apparatus and the display thereof have the design advantage of the slim border.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display, comprising:

a pixel array, comprising a plurality of pixels arranged in an array;

a plurality of scan lines, each of the scan lines being electrically connected to one row of the pixels respectively;

at least one dummy scan line, disposed in at least one side of the scan lines, wherein the dummy scan line is not electrically connected to the pixels;

a plurality of data lines, each of the data lines being electrically connected to one column of the pixels;

a plurality of common lines, each of the common lines being capacitively coupled to one row of the pixels, and the common lines being electrically insulated from each other;

a plurality of common line driving units, each of the common line driving units being electrically connected to one of the common lines;

a plurality of gate driving units, wherein the common line driving units and the gate driving units being respectively disposed at two opposite sides of the pixel array, an $(i+n)^{th}$ scan line being electrically connected to an $(i+n)^{th}$ row of the pixels, an $i^{th}$ common line being capacitively coupled to an $i^{th}$ row of the pixels, and the $i^{th}$ gate driving units being electrically connected to the $(i+n)^{th}$ common line driving units or the $(i-n)^{th}$ common line driving unit through an $i^{th}$ scan line or the dummy scan line, so as to change a voltage of an $(i+n)^{th}$ common line or an $(i-n)^{th}$ common line, wherein i and n are positive integers, and $i>n\geqq 1$; and a source driving circuit, electrically connected to the data lines.

2. The display of claim 1, wherein the pixel array comprises:

a plurality of active devices, each of the active device being electrically connected to one of the scan lines and one of the data lines;

a plurality of pixel electrodes, each of the pixel electrodes being electrically connected to one of the active devices, wherein each of the pixel electrodes is capacitively coupled to one of the common lines to form a storage capacitor;

a common electrode, disposed above the pixel electrodes; and a display medium layer, disposed between the pixel electrodes, and the common electrode, wherein each of the pixel electrodes, a part of the display medium layer and a part of the common electrode form a display media capacitor.

3. The display of claim 1, wherein during a same frame period, when a time point corresponding to a voltage variation of an $i^{th}$ common line is later than a time point corresponding to a voltage variation of an $i^{th}$ scan line, a number of the common lines and a number of the scan lines are respectively x, a number of the dummy scan line is n, and an $x^{th}$ scan line is located between the dummy scan line and an $(x-1)^{th}$ scan line.

4. The display of claim 1, wherein during a same frame period, when a time point corresponding to a voltage variation of an $i^{th}$ common line is later than a time point corresponding to a voltage variation of an $i^{th}$ scan line, a number of the common lines and a number of the scan lines are respectively x, a number of the dummy scan lines is 2n, an $x^{th}$ scan line is located between a part of the dummy scan lines and an $(x-1)^{th}$ scan line, and a $1^{st}$ scan line is located between the rest of the dummy scan lines and a $2^{nd}$ scan line.

5. The display of claim 1, wherein during a same frame period, when a time point corresponding to a voltage variation of an $i^{th}$ common line is earlier than a time point corresponding to a voltage variation of an $i^{th}$ scan line, a number of the common lines and a number of the scan lines are respectively x, a number of the dummy scan line is n, and a $1^{st}$ scan line is located between the dummy scan line and a $2^{nd}$ scan line.

6. The display of claim 1, wherein during a same frame period, when a time point corresponding to a voltage variation of an $i^{th}$ common line is earlier than a time point corresponding to a voltage variation of an $i^{th}$ scan line, a number of the common lines and a number of the scan lines are respectively x, a number of the dummy scan lines is 2n, an $x^{th}$ scan line is located between a part of the dummy scan lines and an $(x-1)^{th}$ scan line, and a $1^{st}$ scan line is located between the rest of the dummy scan lines and a $2^{nd}$ scan line.

7. The display of claim 1, wherein $1\leqq n\leqq 4$.

8. The display of claim 1, wherein an extending direction of the scan lines, an extending direction of the dummy scan line, and an extending direction of the common lines are substantially parallel, while an extending direction of the data lines is substantially perpendicular to the extending direction of the scan lines.

9. An electro-optical apparatus comprising the display of claim 1.

10. A display, comprising:

a pixel may, comprising a plurality of pixels arranged in an array;

a plurality of scan lines, each of the scan lines being electrically connected to one row of the pixels;

at least one dummy scan line, disposed in at least one side of the scan lines, wherein the dummy scan line is not electrically connected to the pixels;

a plurality of data lines, each of the data lines being electrically connected to one column of the pixels;

a plurality of common lines, each of the common lines being capacitively coupled to one row of the pixels, and the common lines being electrically insulated from each other;

a plurality of common line driving units, each of the common line driving units being electrically connected to one of the common lines, wherein each of the common line driving units comprises a switch;

a plurality of gate driving units, wherein the common line driving units and the gate driving units being respectively disposed at two opposite sides of the pixel array, an $(i+n)^{th}$ scan line being electrically connected to an $(i+n)^{th}$ row of the pixels, an $i^{th}$ common line being capacitively coupled to an $i^{th}$ row of the pixels, an $i^{th}$ common line driving unit being connected to the $i^{th}$ common line, and the $i^{th}$ gate driving unit being connected to the switch corresponding to an $(i+n)^{th}$ common line driving unit and the switch corresponding to an $(i-n)^{th}$ common line driving unit through an ith scan line or the dummy scan line, so as to change a voltage of an $(i+n)^{th}$ or an $(i-n)^{th}$ common line, wherein i and n are positive integers, and $i>n\geqq 1$; and a source driving circuit, electrically connected to the data lines.

11. The display of claim 10, wherein the pixel array comprises:

a plurality of active devices, each of the active device being electrically connected to one of the scan lines and one of the data lines;

a plurality of pixel electrodes, each of the pixel electrodes being electrically connected to one of the active devices, wherein each of the pixel electrodes is capacitively coupled to one of the common lines to form a storage capacitor;

a common electrode, disposed above the pixel electrodes; and a display medium layer, disposed between the pixel electrodes and the common electrode, wherein each of the pixel electrodes, a part of the display medium layer, and a part of the common electrode form a display media capacitor.

12. The display of claim 10, wherein during a same frame period, when a time point corresponding to a voltage variation of an $i^{th}$ common line is later than a time point corresponding to a voltage variation of an $i^{th}$ scan line, a number of the common lines and a number of the scan lines are respectively x, a number of the dummy scan lines is 2n, an $x^{th}$ scan line is located between a part of the dummy scan lines and an $(x-1)^{th}$ scan line, and a $1^{st}$ scan line is located between the rest of the dummy scan lines and a $2^{nd}$ scan line.

13. The display of claim 10, wherein during a same frame period, when a time point corresponding to a voltage variation of an $i^{th}$ common line is earlier than a time point corresponding to a voltage variation of an $i^{th}$ scan line, a number of the common lines and a number of the scan lines are respectively x, a number of the dummy scan lines is 2n, an $x^{th}$ scan line is located between a part of the dummy scan lines and an $(x-1)^{th}$ scan line, and a $1^{st}$ scan line is located between the rest of the dummy scan lines and a $2^{nd}$ scan line.

14. The display of claim 10, wherein $1\leqq n\leqq 4$.

15. The display of claim 10, wherein an extending direction of the scan lines, an extending direction of the dummy scan line, and an extending direction of the common lines are substantially parallel, while an extending direction of the data lines is substantially perpendicular to the extending direction of the scan lines.

16. An electro-optical apparatus comprising the display of claim 10.

* * * * *